US011484901B2

(12) United States Patent
Veihl

(10) Patent No.: US 11,484,901 B2
(45) Date of Patent: Nov. 1, 2022

(54) DROP SPREADER CHUTES, DROP SPREADER ASSEMBLIES AND SPREADING VEHICLES

(71) Applicant: THE TORO COMPANY, Bloomington, MN (US)

(72) Inventor: Stephen David Veihl, Iron Mountain, MI (US)

(73) Assignee: THE TORO COMPANY, Bloomington, MN (US)

( * ) Notice: Subject to any disclaimer, the term of this patent is extended or adjusted under 35 U.S.C. 154(b) by 312 days.

(21) Appl. No.: 16/795,227

(22) Filed: Feb. 19, 2020

(65) Prior Publication Data

US 2020/0282418 A1 Sep. 10, 2020

Related U.S. Application Data

(60) Provisional application No. 62/814,248, filed on Mar. 5, 2019.

(51) Int. Cl.

| | |
|---|---|
| ***B05B 13/00*** | (2006.01) |
| ***E01H 5/06*** | (2006.01) |
| ***E01H 10/00*** | (2006.01) |
| ***E01H 5/08*** | (2006.01) |
| ***E01H 5/09*** | (2006.01) |

(52) U.S. Cl.

CPC ..... *B05B 13/005* (2013.01); *E01H 5/061* (2013.01); *E01H 5/08* (2013.01); *E01H 5/09* (2013.01); *E01H 10/007* (2013.01)

(58) Field of Classification Search

CPC ..... E01H 3/02; E01H 10/007; B05B 13/005

See application file for complete search history.

(56) References Cited

U.S. PATENT DOCUMENTS

| | | | | |
|---|---|---|---|---|
| 4,327,541 A * | 5/1982 | Emory | A01C 15/00 | 188/29 |
| 5,340,033 A * | 8/1994 | Whitell | E01C 19/204 | 239/685 |
| 6,383,562 B1 * | 5/2002 | Iversen | A23K 40/30 | 118/668 |

(Continued)

FOREIGN PATENT DOCUMENTS

| | | | |
|---|---|---|---|
| DE | 20 2011 106 085 U1 * | 1/2012 | |
| FR | 3 062 362 * | 1/2017 | |

*Primary Examiner* — Gary S Hartmann

(74) *Attorney, Agent, or Firm* — Marshall, Gerstein & Borun LLP

(57) ABSTRACT

A chute for a drop spreader assembly that includes a body having a vertical axis. A funnel portion of the body has an open top to receive flowable material, a dispensing chute portion of the body has a distal dispensing opening and extending along an angle with respect to the vertical axis, and a plurality of directional vanes of the body protrudes into a flowpath within the dispensing chute portion to direct flowable material to an even distribution pattern through the distal dispensing opening. In some forms, the dispensing chute portion can be divided into a central portion and lateral portions separated from the central portion by gaps adapted to receive structure associated with a snow removal device therethrough. Each of the central and lateral portions can have a plurality of directional vanes protruding into a flowpath thereof.

20 Claims, 5 Drawing Sheets

(56) References Cited

U.S. PATENT DOCUMENTS

| | | | | |
|---|---|---|---|---|
| 7,040,556 | B2 * | 5/2006 | Jones | A01C 17/001 239/289 |
| D673,586 | S | 1/2013 | Truan et al. | |
| D673,587 | S | 1/2013 | Truan et al. | |
| 9,085,863 | B2 | 7/2015 | Norkus et al. | |
| 10,759,458 | B1 * | 9/2020 | Vallez | B62B 1/22 |

* cited by examiner

DROP SPREADER CHUTES, DROP SPREADER ASSEMBLIES AND SPREADING VEHICLES

CROSS-REFERENCE TO RELATED APPLICATION

This application claims the benefit of U.S. Provisional Application No. 62/814,248, filed Mar. 5, 2019, which is hereby incorporated by reference herein in its entirety.

FIELD OF THE DISCLOSURE

The present disclosure generally relates to outdoor power equipment and, more particularly, to spreadable material dispensing equipment.

BACKGROUND

Spreader machines are used to distribute various types of materials on the ground. Applications for dispensing various materials include ice removal, agriculture, and lawn care in various settings, such as for commercial or residential properties. One particular spreader machine is a stand-on, zero turn machine, which is gaining ground in the snow/ice control industry, particularly for sidewalk applications. As these machines have been developed, design emphasis has been placed on maneuverability, compactness, and an integrated arrangement of three snow/ice accessories, which include a snow removal device, a liquid deicer system, and a dry deicer system.

The dry deicer system can include a hopper spreader of either a broadcasting or drop-type. A drop-type hopper spreader is typically desirable because material can be more precisely dispensed, where an evenly distributed drop pattern equal to the width of the vehicle is commonly desired. A broadcast spreader mounted to the front of the machine projects salt in front of the machine, while a drop spreader can drop behind it. Therefore, a drop-type hopper spreader allows an operator to remove snow and device in a single pass, enhancing efficiency.

Difficulties arise when trying to package a drop-type spreader into such a machine. In most applications, such a spreader can be mounted either in a low configuration or high configuration. In a low mounting, the spreader is mounted below the deck of the vehicle, between the front and rear wheels, which is often under the engine, a hydraulic system, and a liquid deicer system. This allows the drop-type spreader to dispense very close to the ground, which optimizes pattern precision and reduces blowing salt dust. There are several disadvantages to this setup, however, which include a difficulty filling the hopper, a difficulty in working on the spreader, and a limited hopper size due to space constraints imposed by the structural chassis of the vehicle. In a high mounting, the spreader is mounted above the deck. While this configuration provides an easily fillable hopper that is uninhibited by chassis constraints and a spreader that can easily be removed, serviced, and sold as an option with minimum install time, dispensed material does not have a clear path to the ground due to structural and mechanical components of the vehicle.

SUMMARY

A material chute, drop spreader assembly, snow removal and deicer machine, and related methods described herein that redirect flowable deicer material as it is dropped within the chute to guard other vehicle components from the material and/or optimize a drop pattern with an array of strategically placed directional vanes. The spreader configuration described herein enables an above-deck mounting configuration for a drop spreader that dispenses an even material pattern the width of the vehicle without compromising the cleanliness or design of other vehicle components.

In accordance with a first aspect, a chute for a drop spreader assembly is disclosed that includes a body having a vertical axis. A funnel portion of the body has an open top to receive flowable material, a dispensing chute portion of the body has a distal dispensing opening and extending along an angle with respect to the vertical axis, and a plurality of directional vanes of the body protrudes into a flowpath within the dispensing chute portion to direct flowable material to an even distribution pattern through the distal dispensing opening.

According to some forms, the chute can include one or more of the following aspects: the body can include a central throughbore defined by a sidewall extending therethrough along an axis generally perpendicular to the vertical axis, where the central throughbore adapted to receive structure associated with a snow removal device therethrough; the body can include strengthening ribs extending between the funnel portion and the dispensing chute portion; or the body can include one or more openings extending through a rear wall thereof adjacent to the distal dispensing opening.

According to another form, the dispensing chute portion can be divided into a central portion and lateral portions separated from the central portion by gaps adapted to receive structure associated with a snow removal device therethrough. Each of the central and lateral portions can have a plurality of directional vanes protruding into a flowpath thereof. In further forms, the lateral portions can each have a curved configuration with interior portions and exterior portions extending along different angles from the vertical axis, the plurality of directional vanes of the central portion can include two rows of a plurality of directional vanes in a stacked orientation, and/or the central portion can extend a longer distance than the lateral portions.

In accordance with a second aspect, a drop spreader assembly is disclosed herein that includes the chute of any of the above forms.

According to one form, the drop spreader assembly can include a hopper fluidly coupled with the chute and, in a further form, a roller housing disposed between the hopper and the chute and a roller extending laterally through the roller housing.

In accordance with a third aspect, a snow removal and deicer vehicle is disclosed that includes the drop spreader assembly of any one of the above forms.

According to one form, the snow removal and deicer vehicle can include a snow removal device and a liquid deicer system, where the snow removal device can be one of a plow, snowblower, or power broom.

BRIEF DESCRIPTION OF THE DRAWINGS

The above needs are at least partially met through provision of the embodiments described in the following detailed description, particularly when studied in conjunction with the drawings, wherein.

DETAILED DESCRIPTION

A chute for a drop-type spreader, a drop-type spreader including a chute and hopper, and a snow removal and deicer vehicle is described herein. The chute allows the drop spreader to be mounted above deck on the vehicle to allow for quick and even filling, faster spreader removal/install, and easier maintenance. Further, an above-deck configuration allows for more flexibility in hopper capacity and shape. When used for deicing applications, the chute keeps the corrosive deicing material from falling on and building up on vehicle components while also producing an even dispense pattern of deicing material.

Directional vanes in the chute advantageously direct material around structure or components of the vehicle and help to disperse the deicing material on the ground in an even density and eliminate striping. Additionally, the directional vanes can be used to change the pattern width or bias material towards a side of the vehicle. Further, with this configuration a drop width that exceeds spreader dispense width can be achieved.

Figure 1:
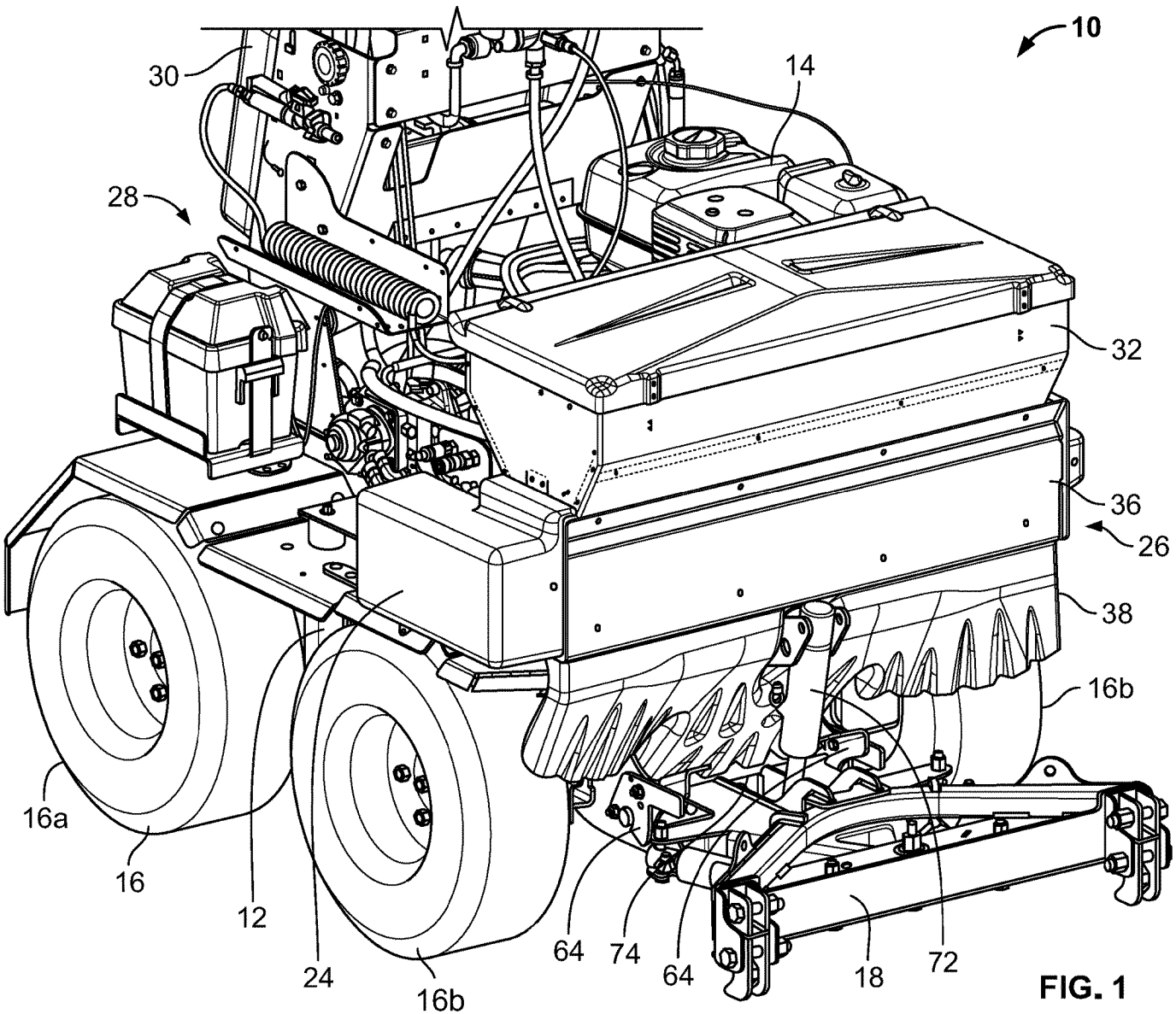
FIG. 1 is a perspective view of a snow removal and deicer vehicle in accordance with various embodiments.
Figure 2:
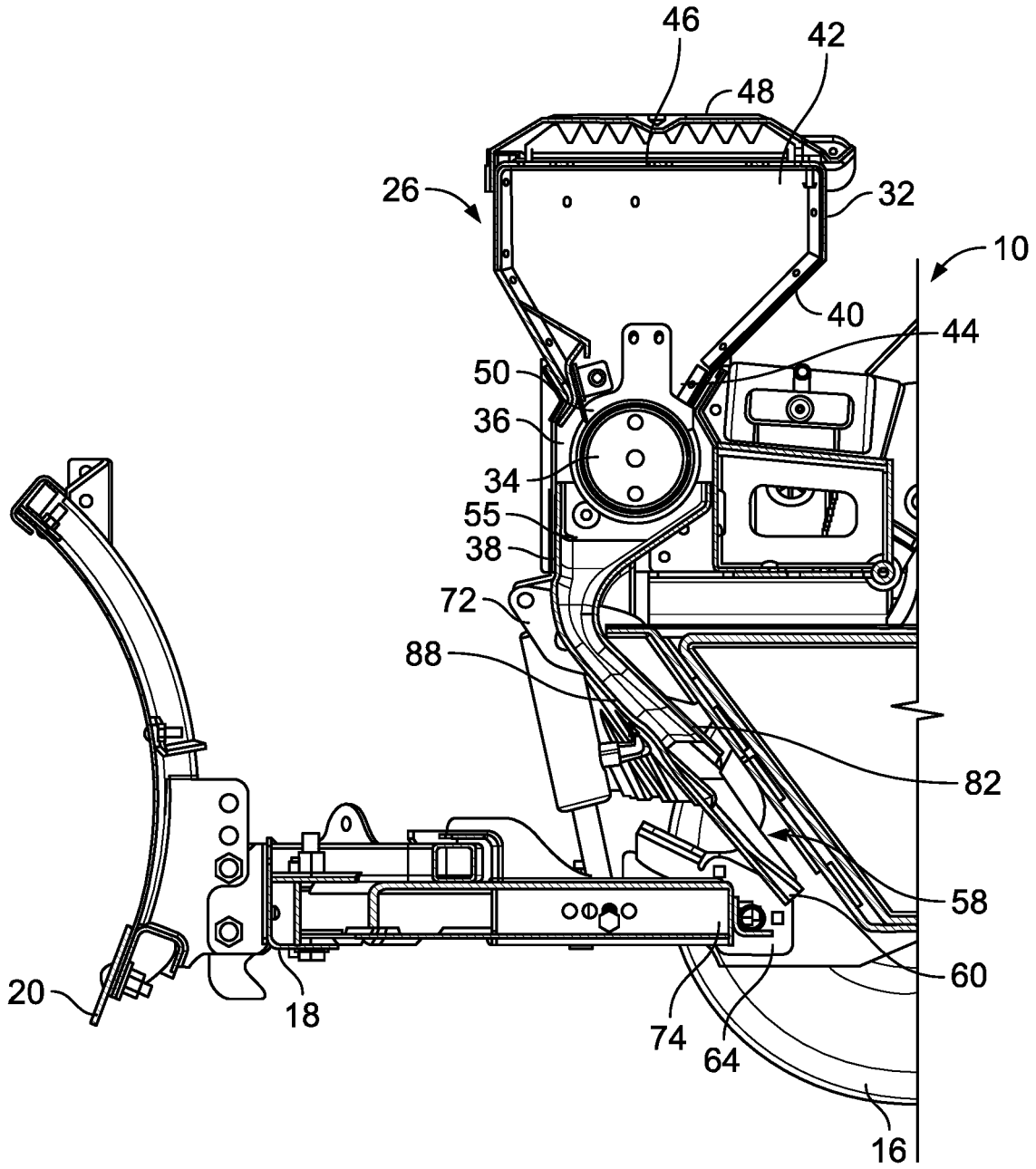
FIG. 2 is a cross-sectional view of the vehicle of FIG. 1.

An example snow removal vehicle 10 is shown in FIGS. 1 and 2. The vehicle 10 includes a chassis 12 supporting an engine or motor 14 and wheels 16. A drive linkage operably couples the motor 14 to two or more of drive wheels 16*a* to drive movement of the vehicle 10. In some forms, the vehicle 10 can include a zero-turn steering assembly with drive wheels 16*a* rotating independently of one another and caster wheels 16*b*. To turn, the drive wheels 16*a* can rotate at different speeds with respect to one another. For example, one of the drive wheels 16*a* can be stationary, and/or the drive wheels 16*a* can rotate in opposite directions with respect to one another. The vehicle 10 can alternatively include differential steering such that left and right drive wheels 16*a* do not spin at the same speed while the vehicle 10 is turned, allowing for a tight turn radius. In another form, the drive wheels 16*a* can be operably coupled together to rotate at the same speed, such as through a common axle. As shown, the vehicle 10 further includes a snow removal device 18, a liquid deicer system 22 including a tank 24 and dispensing components, such as a pump and spray nozzles, and a drop spreader assembly 26 for a solid, flowable deicing material. Suitable deicing materials can include, for example, salt, sodium chloride, calcium chloride, potassium chloride, magnesium chloride, urea, sodium acetate, calcium magnesium acetate, ammonium nitrate, ammonium sulfate, and blends thereof, in flake and/or pellet form. In some examples, the snow removal device 18 can be a plow 20, snowblower, or power broom. Typically, it can be desirable for a spray pattern of the liquid deicer system 22 to be the width of the vehicle 10 and to be evenly distributed.

In some versions, the vehicle 10 can be a standing vehicle with a rear standing platform 28 and a rearwardly-facing control panel 30 accessible from the standing platform 28. This arrangement provides user control of the various components of the vehicle 10. For example, the control panel 30 can include associated drive control handles to control drive and reverse settings, as well as turning operations for the vehicle 10. The control panel 30 can further include controls for operation of the snow removal device 18, liquid deicer system 22, and drop spreader assembly 26. Other handling controls are possible for the various drive wheel configurations discussed above, including steering wheels and the like. Sitting configurations are also possible for the rideable equipment.

Figure 3:
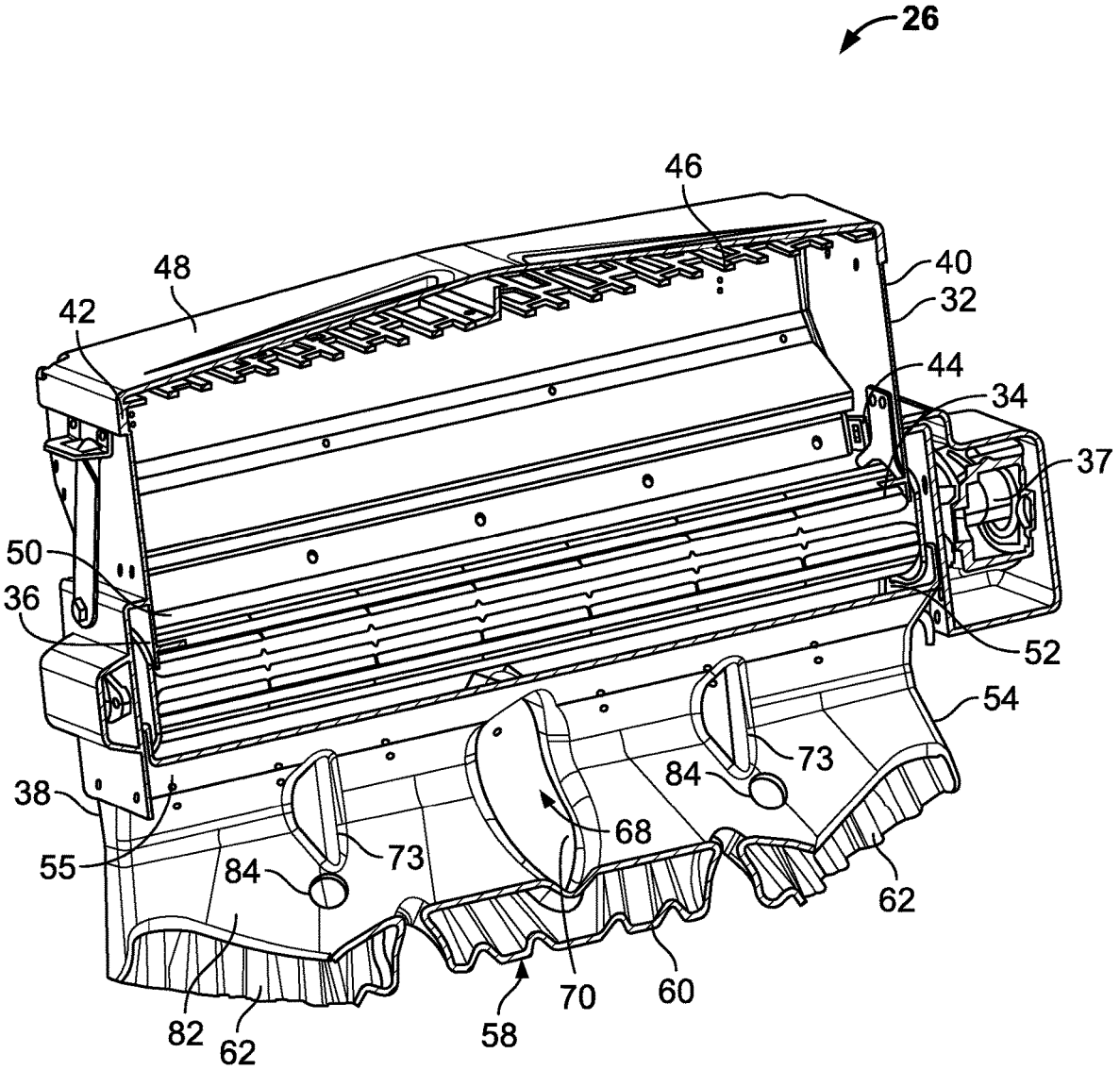
FIG. 3 is a cross-sectional view of a drop spreader assembly suitable for use with the vehicle of FIG. 1.
Figure 4:
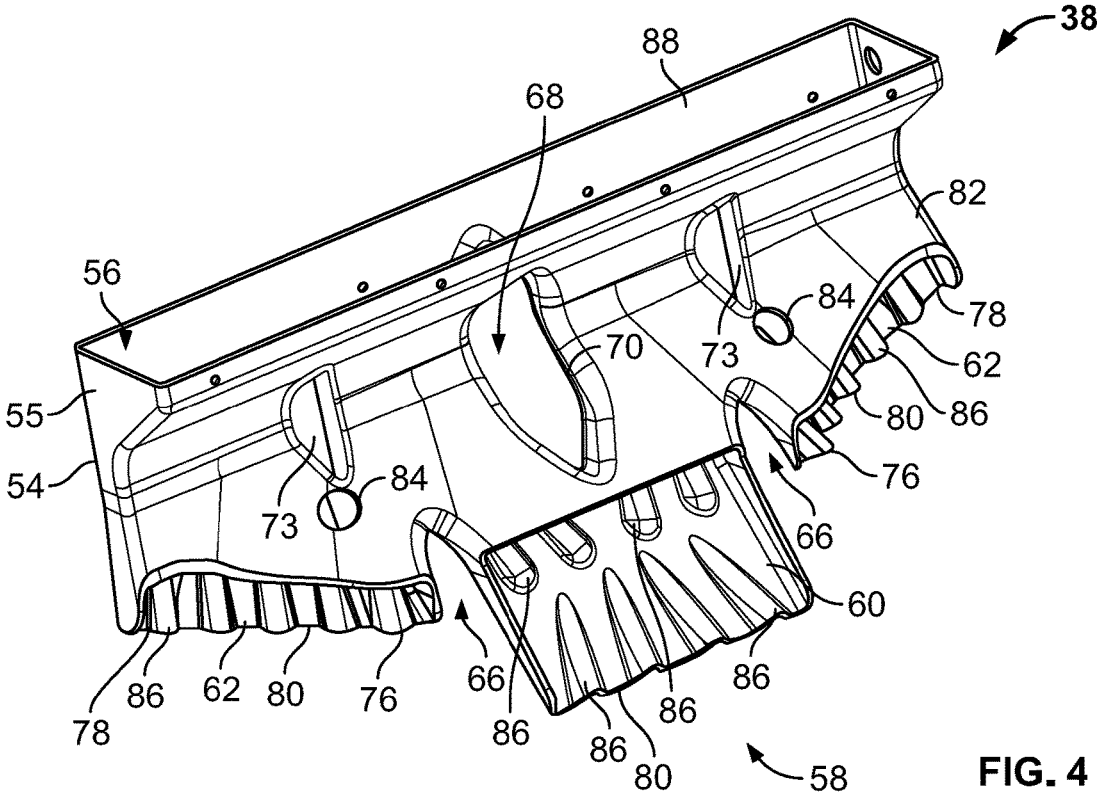
FIG. 4 is a front perspective view of a chute for a drop spreader assembly in accordance with various embodiments.
Figure 5:
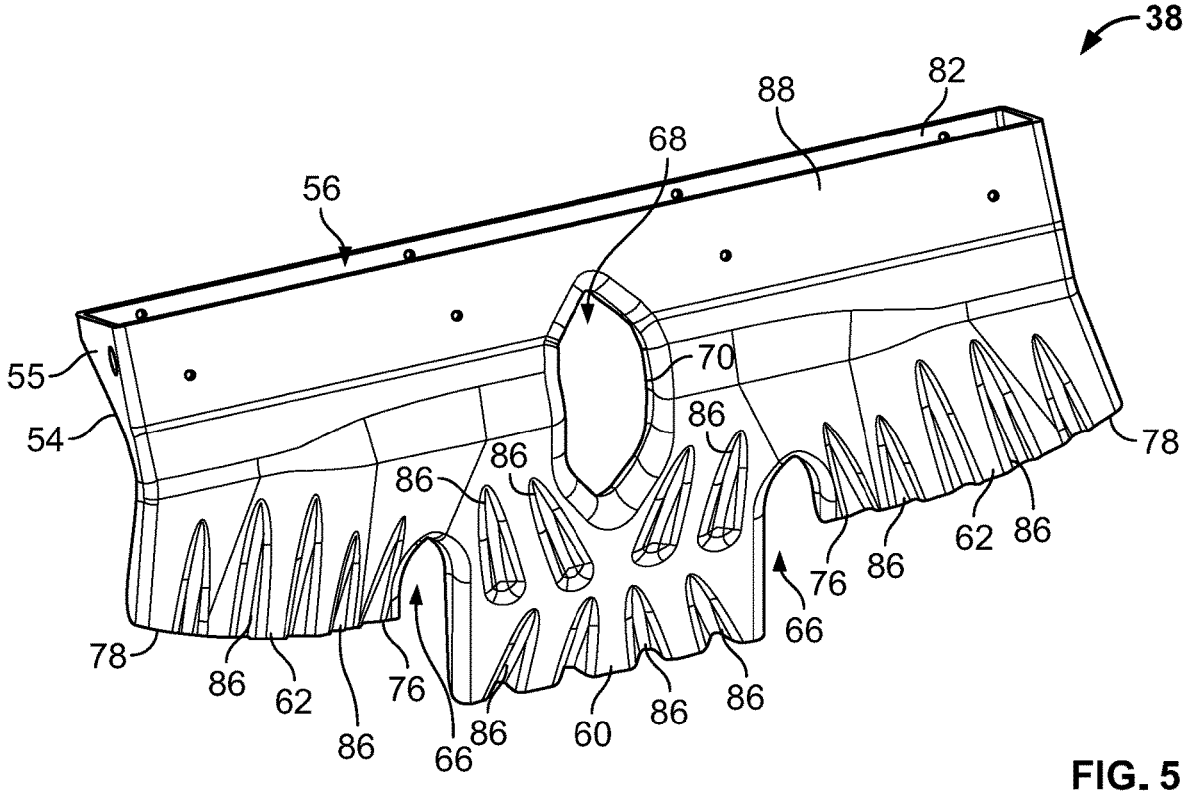
FIG. 5 is a rear perspective view of the chute of FIG. 4.
Figure 6:
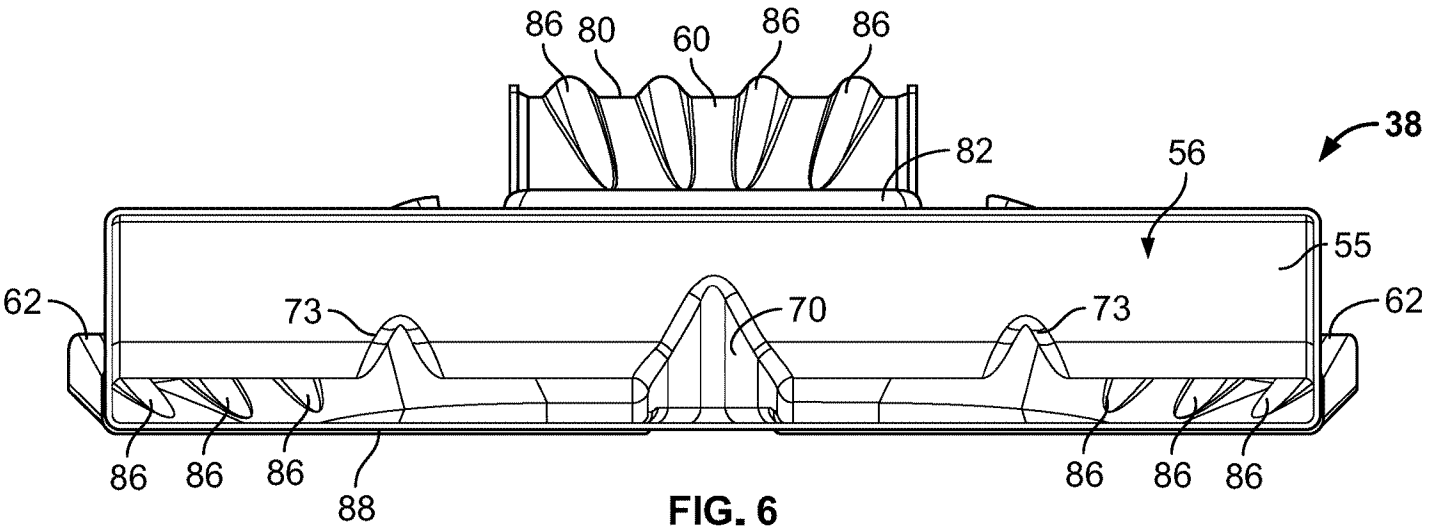
FIG. 6 is a top plan view of the chute of FIG. 4.
Figure 7:
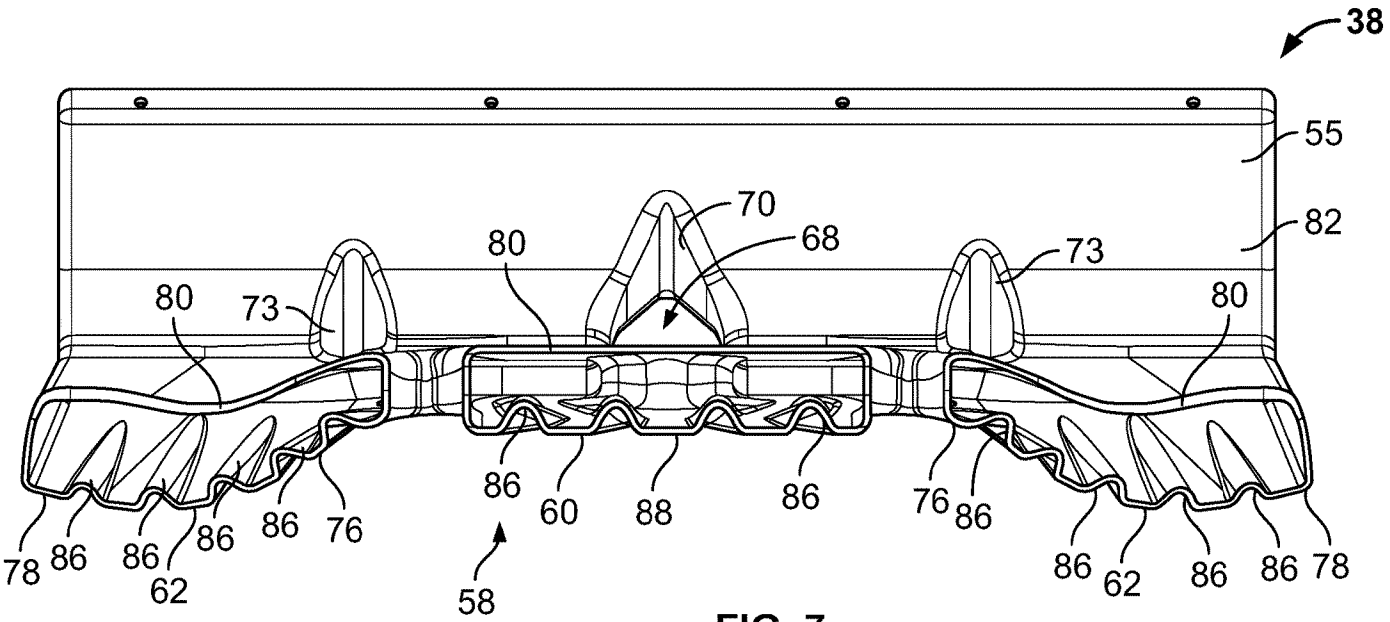
FIG. 7 is a bottom plan view of the chute of FIG. 4.

Referring now to FIGS. 2 and 3, the drop spreader assembly 26 includes a hopper 32, a roller 34 within a roller housing 36 and driven by a motor 37, and a chute 38. The hopper 32 includes a housing 40 having an at least partially tapered profile from an open top 42 to a bottom outlet 44. The hopper 32 can further include a screen 46 extending across the open top 42 to break up deicing material as it is poured into the hopper 32 and a cover 48 to secure over the top 42. The roller housing 36 includes a top inlet 50 and a bottom outlet 52 and is mounted between the bottom outlet 44 of the hopper 32 and the chute 38.

Details of the chute 38 are shown in FIGS. 4 to 7. The chute 38 includes a body 54 with a funnel 55 with an open top 56 to receive deicing material from the roller housing 36 and an opposite, bottom dispensing opening 58. The funnel 55 has an inwardly tapered configuration to reduce a depth of the chute 38 from the coupling with the roller housing 36 to a narrow depth extending to the dispensing opening 58.

As shown, the dispensing opening 58 is divided into three sections to divert the deicing material around structure and components of the vehicle 10. Specifically, the body 54 includes a central dispensing chute portion 60 and outer dispensing chute portions 62 disposed on lateral sides of the central portion 60 and separated therefrom by gaps 66. In the illustrated form, mounting structures 64, specifically a plow push-frame, for the plow 20 extend through the gaps 66 to connect to structure of the chassis 12 or components coupled thereto. Further, the body 54 can include a central through-bore 68 defined by a sidewall 70 to receive additional mounting structure 72 for the plow 20 therethrough, such as a hydraulic lift cylinder and associated components as shown in FIG. 1. If desired, the chute 38 can also include strengthening ribs 73 disposed on either side of the through-bore 68 extending between the funnel 55 and the outer chute portions 62.

The dispensing chute portions 60, 62 angle away from a vertical axis running through the body 54 to direct deicing material to desired areas below the vehicle 10. Specifically, the chute 38 is configured to be mounted to the vehicle 10 so that the dispensing chute portions 60, 62 extend rearwardly away from the plow 20. This allows the chute 38 to dispense the deicing material rearwardly of the mounting structure and components for the plow 20. Additionally, in the illustrated form, the central portion 60 extends downwardly and rearwardly a further distance than the outer portions 62. With this configuration, the central portion 60 can project over central mounting structure and components 74 below the chassis 12, while the outer portions 62 direct deicing material laterally outwardly of the mounting structure 64, 74 and partially in front of the wheels 16 of the vehicle 10. If desired, the outer portions 62 can have a curved configuration to extend around the front wheels 16 of the vehicle 10. The curved configuration causes the outer portions 62 to have a more rearwardly angled interior end 76 and a relatively more vertical exterior end 78.

Interior surfaces of the chute 38 can be smooth and swept to minimize directional disruptions and allow a quick ramp up of kinetic energy for the deicing material. The chute 38 can also include features that avoid clogging of the deicing material. In one example, distal ends 80 and rear wall portions of the dispensing chute portions 60, 62 can be trimmed as high as possible to reduce the chances of a clog or interference with snow. In another example, a rear wall 82 of the chute 38 can include openings 84 extending therethrough adjacent to the dispensing opening 58.

The dispensing chute portions 60, 62 can further include a series or array of directional vanes 86 to direct the flow of deicing material through and out of the chute 38. The directional vanes 86 operate to evenly direct the deicing material around the split features to avoid striping and heavy lines in the drop pattern. As shown, the directional vanes 86 are portions of a front wall 88 of the chute 38 that protrude inwardly into a flow path of the deicing material. The directional vanes 84 can have a conical or tear-drop shape configuration as shown to guide the deicing material along the sides thereof. The directional vanes 84 can start to protrude on the front wall 88 below the top funnel 55. In some examples, the directional vanes 84 can be disposed between about 2 and about 10 inches below the top funnel 55, or between about 4 and about 8 inches below the top funnel 55, or about five inches below the top funnel 55. Each of the dispensing chute portions 60, 62 can include directional vanes 86 that extend to a distal end thereof to control the spread pattern of the deicing material as it exits the chute 38. As shown, the central chute portion 60 can further include a second row of directional vanes 86 in a stacked configuration. The second row of directional vanes 86 at least partially operate to direct the deicing material to a middle of the chute 38 around the central throughbore 68.

In the illustrated example, the outer chute portions 62 include five directional vanes 84 with relatively shorter vanes 84 in the interior end 76 and relatively longer vanes 84 in the exterior end 78. The central chute portion 60 includes stacked rows of four directional vanes 84 each.

While the drop spreader assembly 26 and chute 38 has been described above with respect to a use on a snow removal and deicer vehicle 10, the drop spreader 26 and chute 38 with directional vanes 84 can also be mounted to the rear of a vehicle, such as a UTV or truck. Further, the drop spreader assembly 26 and chute 38 can be designed small enough to fit in a vehicle bed, while the effective spreader width can be increased to match the vehicle track width.

It will be appreciated that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. The same reference numbers may be used to describe like or similar parts. Further, while several examples have been disclosed herein, any features from any examples may be combined with or replaced by other features from other examples. Moreover, while several examples have been disclosed herein, changes may be made to the disclosed examples within departing from the scope of the claims.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A drop spreader assembly comprising:

a chute comprising:

a body having a vertical axis;

a funnel portion of the body having an open top to receive flowable material;

a dispensing chute portion of the body having a distal dispensing opening and extending along an angle with respect to the vertical axis; and a plurality of directional vanes of the body protruding into a flowpath within the dispensing chute portion to direct flowable material to an even distribution pattern through the distal dispensing opening;

a hopper fluidly coupled with the chute; and a roller housing disposed between the hopper and the chute and a roller extending laterally through the roller housing.

2. The chute of claim 1, wherein the body further comprises a central throughbore defined by a sidewall extending therethrough along an axis generally perpendicular to the vertical axis, the central throughbore adapted to receive structure associated with a snow removal device therethrough.

3. The chute of claim 1, wherein the dispensing chute portion is divided into a central portion and lateral portions separated from the central portion by gaps adapted to receive structure associated with a snow removal device therethrough, each of the central and lateral portions having a plurality of directional vanes protruding into a flowpath thereof.

4. The chute of claim 3, wherein the lateral portions each have a curved configuration with interior portions and exterior portions extending along different angles from the vertical axis.

5. The chute of claim 3, wherein the plurality of directional vanes of the central portion comprises two rows of a plurality of directional vanes in a stacked orientation.

6. The chute of claim 3, wherein the central portion extends a longer distance than the lateral portions.

7. The chute of claim 1, wherein the body further comprises strengthening ribs extending between the funnel portion and the dispensing chute portion.

8. The chute of claim 1, wherein the body further comprises one or more openings extending through a rear wall thereof adjacent to the distal dispensing opening.

9. A snow removal and deicer vehicle including the drop spreader assembly of claim 1.

10. The snow removal and deicer vehicle of claim 9 further comprising:

a snow removal device; and a liquid deicer system.

11. The snow removal and deicer vehicle of claim 10, wherein the snow removal device comprises one of a plow, snowblower, or power broom.

12. A chute for a drop spreader assembly, the chute comprising:

a body having a vertical axis;

a funnel portion of the body having an open top to receive flowable material;

a dispensing chute portion of the body having a distal dispensing opening and extending along an angle with respect to the vertical axis; and a plurality of directional vanes of the body protruding into a flowpath within the dispensing chute portion to direct flowable material to an even distribution pattern through the distal dispensing opening;

wherein the dispensing chute portion is divided into a central portion and lateral portions separated from the central portion by gaps adapted to receive structure associated with a snow removal device therethrough, each of the central and lateral portions having a plurality of directional vanes protruding into a flowpath thereof.

13. The chute of claim 12, wherein the body further comprises a central throughbore defined by a sidewall extending therethrough along an axis generally perpendicular to the vertical axis, the central throughbore adapted to receive structure associated with a snow removal device therethrough.

14. The chute of claim 12, wherein the lateral portions each have a curved configuration with interior portions and exterior portions extending along different angles from the vertical axis.

15. The chute of claim 12, wherein the plurality of directional vanes of the central portion comprises two rows of a plurality of directional vanes in a stacked orientation.

16. The chute of claim 12, wherein the central portion extends a longer distance than the lateral portions.

17. The chute of claim 12, wherein the body further comprises at least one of:

strengthening ribs extending between the funnel portion and the dispensing chute portion; or one or more openings extending through a rear wall thereof adjacent to the distal dispensing opening.

18. A drop spreader assembly comprising:

the chute of claim 12; and a hopper fluidly coupled with the chute.

19. The drop spreader assembly of claim 18 further comprising a roller housing disposed between the hopper and the chute and a roller extending laterally through the roller housing.

20. A snow removal and deicer vehicle comprising:

the drop spreader assembly of claim 18;

a snow removal device; and a liquid deicer system.

* * * * *